US006470507B2

(12) United States Patent
Watson

(10) Patent No.: US 6,470,507 B2
(45) Date of Patent: Oct. 29, 2002

(54) HEAD CRADLE

(76) Inventor: Donna Watson, 1630 NE. 20th St., Ft. Lauderdale, FL (US) 33305

( * ) Notice: Subject to any disclaimer, the term of this patent is extended or adjusted under 35 U.S.C. 154(b) by 0 days.

(21) Appl. No.: 09/922,751

(22) Filed: Aug. 6, 2001

(65) Prior Publication Data

US 2002/0035751 A1 Mar. 28, 2002

Related U.S. Application Data

(60) Provisional application No. 60/223,679, filed on Aug. 8, 2000.

(51) Int. Cl.[7] ..... A45D 44/10
(52) U.S. Cl. ..... 4/523
(58) Field of Search ..... 4/515–523, 575.1

(56) References Cited

U.S. PATENT DOCUMENTS

| | | | | | |
|---|---|---|---|---|---|
| 522,192 | A | * | 7/1894 | Browne | 4/523 X |
| 1,882,624 | A | | 10/1932 | Jackson | |
| 2,592,160 | A | * | 4/1952 | Kunes | 4/575.1 |
| 2,954,077 | A | * | 9/1960 | Wanner | 4/522 |
| 3,579,656 | A | | 5/1971 | Guarrasi | 4/159 |
| 3,731,325 | A | | 5/1973 | Guarrasi | 4/159 |
| 4,327,452 | A | | 5/1982 | Swatzell | 4/523 |
| 4,385,408 | A | | 5/1983 | Rhodes | 4/523 |
| 4,649,580 | A | | 3/1987 | Bastien | 4/523 |
| 4,669,132 | A | | 6/1987 | Courson | 4/523 |
| 4,763,364 | A | | 8/1988 | Morgan | 4/523 |
| 4,766,620 | A | | 8/1988 | Boyhan | 4/516 |
| 4,864,667 | A | | 9/1989 | Adams | 4/519 |
| 4,901,378 | A | | 2/1990 | Reddell | 4/515 |
| 4,949,407 | A | | 8/1990 | Singer et al. | 4/523 |
| 5,177,820 | A | * | 1/1993 | Varallo | 4/523 |
| 5,239,711 | A | | 8/1993 | Tafur | 4/523 |
| 5,245,713 | A | | 9/1993 | Tickle | 4/516 |
| 5,377,365 | A | | 1/1995 | Hakim | 4/523 |
| 5,924,145 | A | | 7/1999 | Najar | 4/523 |

* cited by examiner

*Primary Examiner*—Charles E. Phillips
(74) *Attorney, Agent, or Firm*—Gifford, Krass, Groh, Sprinkle, Anderson & Citkowski, P.C.

(57) ABSTRACT

A cradle for supporting a user's head relative to a wash basin includes a brace adapted to support a user's neck. The brace has a first end positioned adjacent the head of the user and a second end disposed toward the user's shoulder area. The brace is secured to the wash basin by a hinge that allows pivoting motion of the brace relative to the wash basin between a first, upright position in which the first end of the brace is vertically above the second end, and a second position in which the first and second ends of the brace are horizontally aligned over the basin. The brace is biased toward the upright position such that the user may bring her neck against the brace while it is in the upright position and the brace will support the neck as the user's head is moved into the basin for washing.

8 Claims, 7 Drawing Sheets

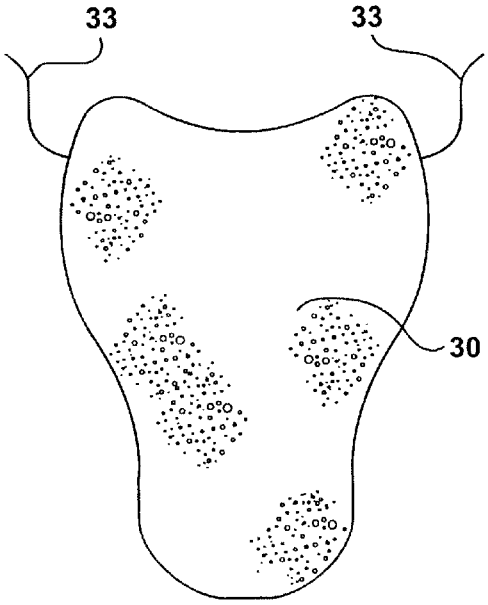
FIG - 3C
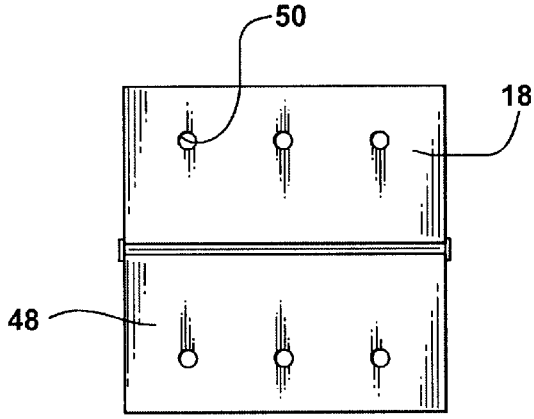
FIG - 5A
FIG - 5B
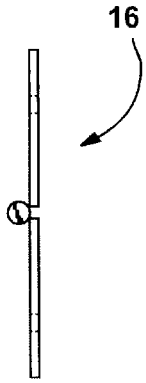
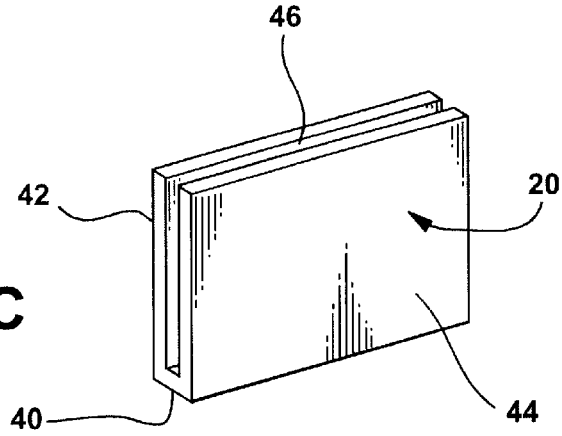
FIG - 5C

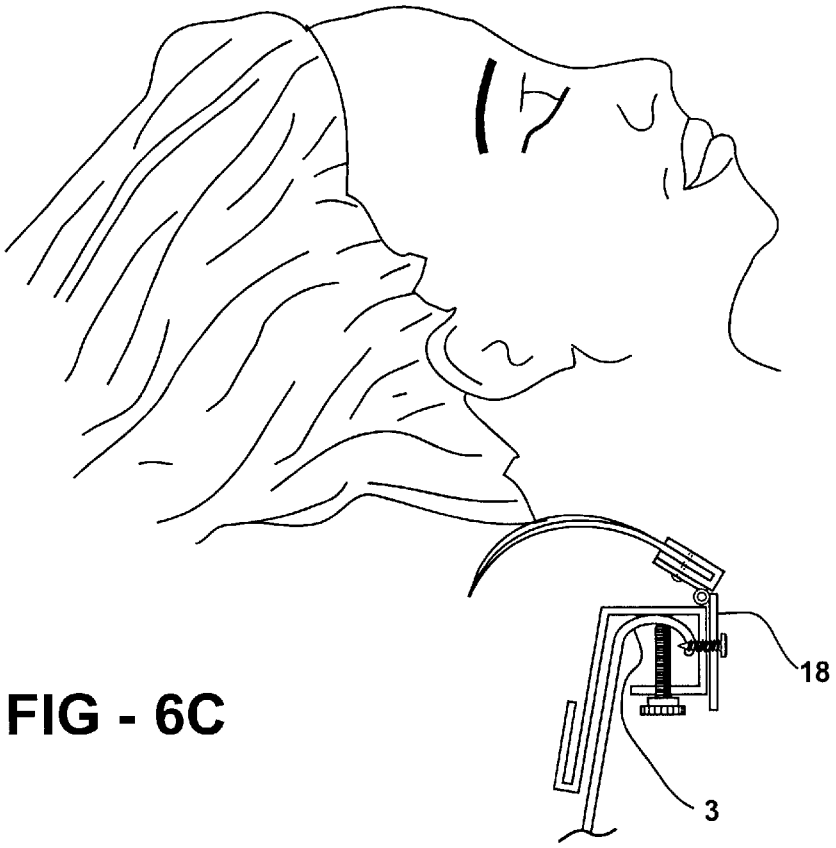
FIG - 6C
FIG - 6D
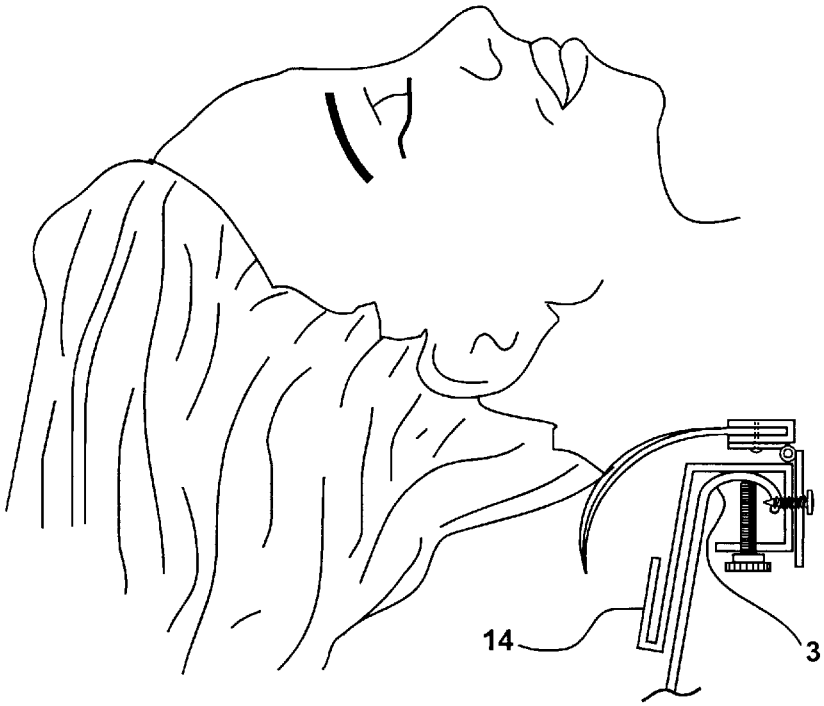

HEAD CRADLE

RELATED APPLICATION

This application claims priority of U.S. Provisional Patent Application No. 60/223,679 filed Aug. 8, 2000, and is incorporated herein by reference.

BACKGROUND OF THE INVENTION

1. Field of the Invention

The present invention is directed to a head cradle. More particularly, the present invention is directed to a head cradle apparatus that is adapted to safely position a person's head and neck in a wash basin such as a sink, tub or the like.

2. Reference to Related Art

It is often necessary to wash an individual's hair before it is cut or styled. In order to simplify this task, it is well known that modern wash basins (e.g., sinks) are provided with contoured front walls that support the individual's neck while one is having his or her hair washed. Typically, the individual's head is positioned in the wash basin by placing the individual into a chair that is then reclined toward the wash basin. Unfortunately, techniques for lowering and raising the individual into and out of a wash basin are often haphazard and under certain conditions may present a serious risk of injury. Indeed, incorrectly lowering or positioning an individual into a wash basin can result in cerebral vascular accidents ("CVAs") and cervical disk injuries.

The prior art discloses a variety of devices that have use in supporting a person's head and neck once it is placed in the basin. Clearly absent from this art is any teaching of an apparatus that assists in the placement of the individual's head and neck in the basin and provides support during the washing process.

SUMMARY OF THE INVENTION

The present invention is directed to a cradle that assists the individual in lowering and raising his or her head and neck into and out of a wash basin. Preferably, the present invention includes a contoured brace that is adapted to be supported against the user's neck. The brace has a first end that is positioned adjacent the head of a user and a second end that is disposed toward a user's shoulder area. A hinge is provided so as to allow pivoting motion of the brace relative to the wash basin between a first, upright position in which the first end of the brace is vertically above the second end, and a second position in which the first and second ends of the brace are generally horizontally aligned over the basin. The hinge preferably has a first leaf that is connected to the second end of the brace and a second leaf connected to the wash basin. Preferably, the brace is biased toward the upright position so that a user may bring his or her neck against the brace while it is in the upright position and the brace will support the neck as the user's head is moved or lowering into a washing position relative to the basin. Once the user has finished having his or her hair washed, the brace assists the user with the controlled raising of his or her head and neck out of the wash basin.

The preferred means of biasing the brace toward the upright position is through the use of a spring hinge. Additionally, a pad may be positioned on the brace in order to provide an additional level of comfort to the user.

BRIEF DESCRIPTION OF THE DRAWINGS

These and other features, aspects and advantages of the present invention will become better understood with regard to the following description, claims and accompanying drawings wherein:

FIGS. 3A–3C are planar views of the neck brace and padding for use with the present invention;

FIGS. 5A and 5C are views of the hinge assembly of the present invention; and FIGS. 6A–6D are planar views demonstrating operation of a preferred embodiment of the present invention.

DETAILED DESCRIPTION OF THE PREFERRED EMBODIMENTS

Figure 1:
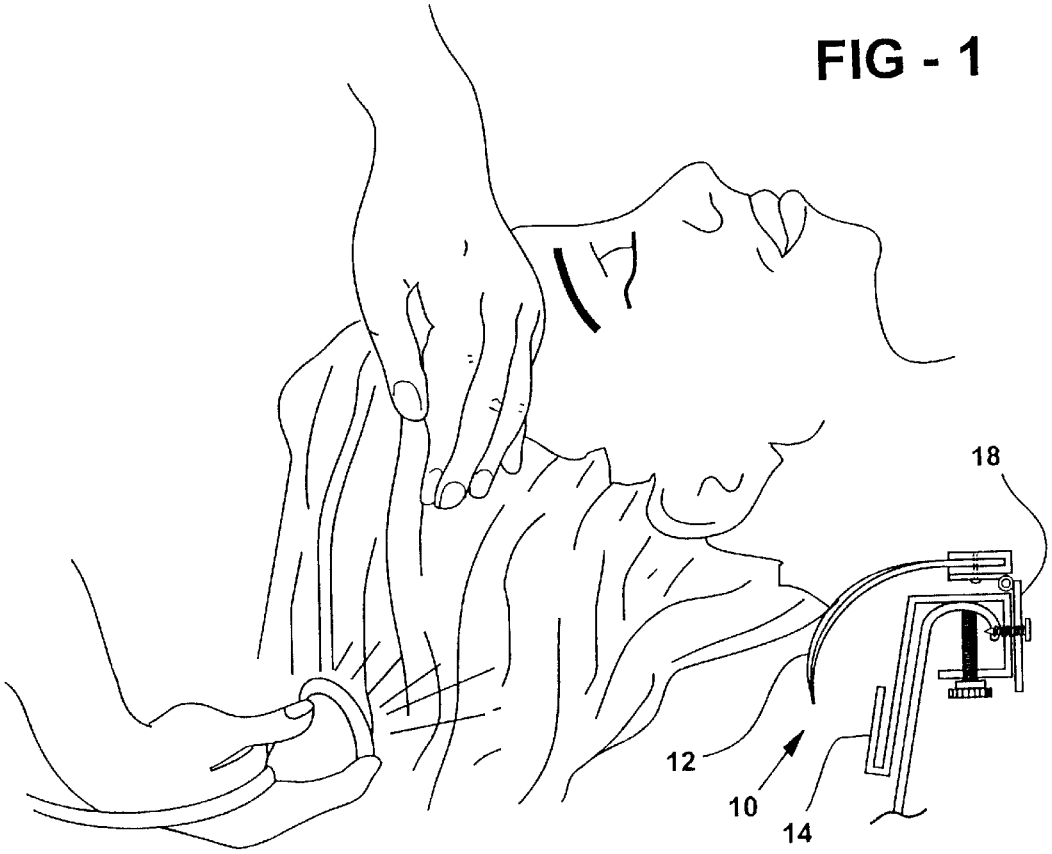
FIG. 1 is a perspective view of a cradle constructed in accordance with the present invention.

Referring now to FIGS. 1, 2A, 3A and 5A, there is shown a preferred embodiment of a cradle 10 constructed in accordance with the present invention. Preferably, the cradle 10 includes a brace 12 and a mounting bracket 14. A hinge assembly 16, including a hinge 18 and a fastener clamp 20, is secured to the brace 12 and mounting bracket 14 to permit pivotable movement of the neck brace 12 when the cradle 10 is affixed, via the mounting bracket 14, to a wash basin 1.

Referring now to FIGS. 2A–2B and 3A–3C, the brace 12 of the present invention preferably has a contoured or form fitting base 22 with a first end 23 that is adapted to be positioned adjacent the head of a user and a second end 24 that is disposed toward a user's shoulder area. Additionally, the brace 12 has a pair of raised sidewalls 25, 26 that with the base 22 provide the brace 12 with a generally U-shaped cross-section. The brace 12 is preferably constructed of plastic such that it may be easily constructed or molded into a desired form. However, other materials such as stainless steel, aluminum, metal alloys, or other materials may be used provided they have the requisite qualities of strength and flexibility. Notably, the life of the brace 12 may be prolonged if it is constructed of a rust resistant material.

Still referring to FIGS. 2A–2B and 3A–3C, the brace 12 of the present invention is preferably designed to accommodate and fit the average neck size of the male and female populations. Alternatively, a reduced size brace 12 may be constructed for use by children. It will also be appreciated that the brace 12 may be custom formed or molded in order to meet the needs of a particular individual.

Figure 3A:
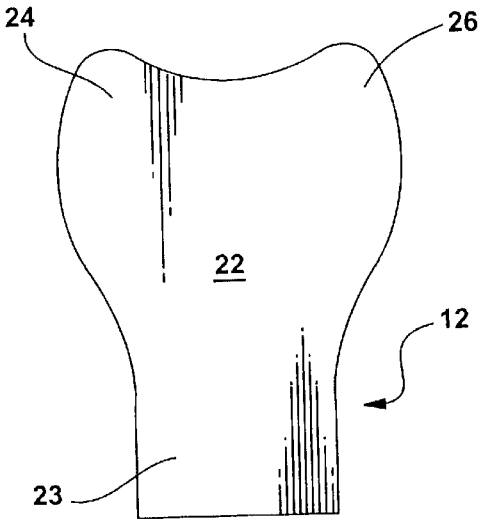
Figure 3B:
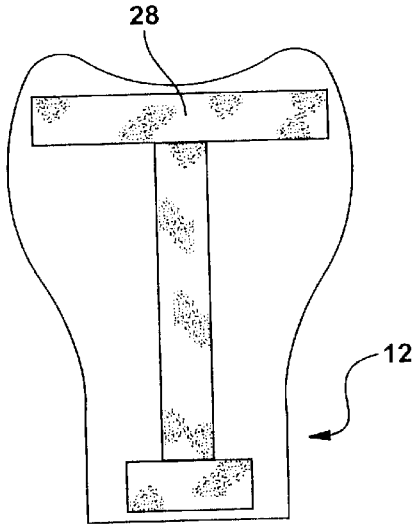
Figure 2A:
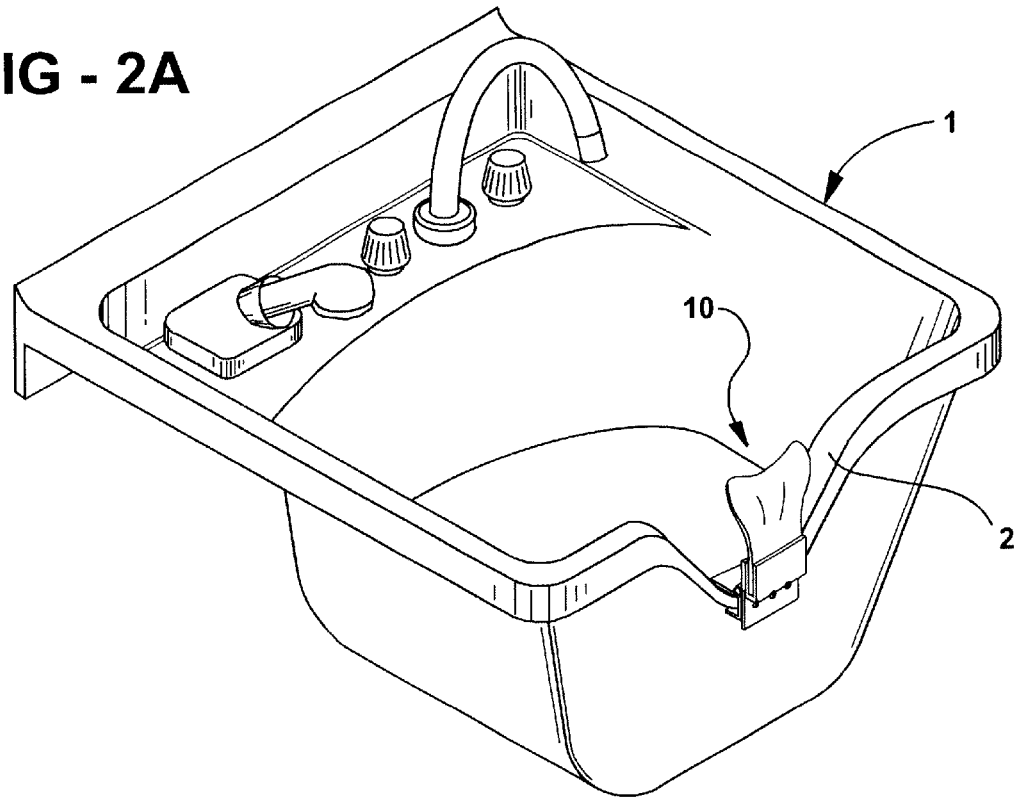
FIGS. 2A and 2B are perspective views of a preferred embodiment of the present invention.
Figure 2B:
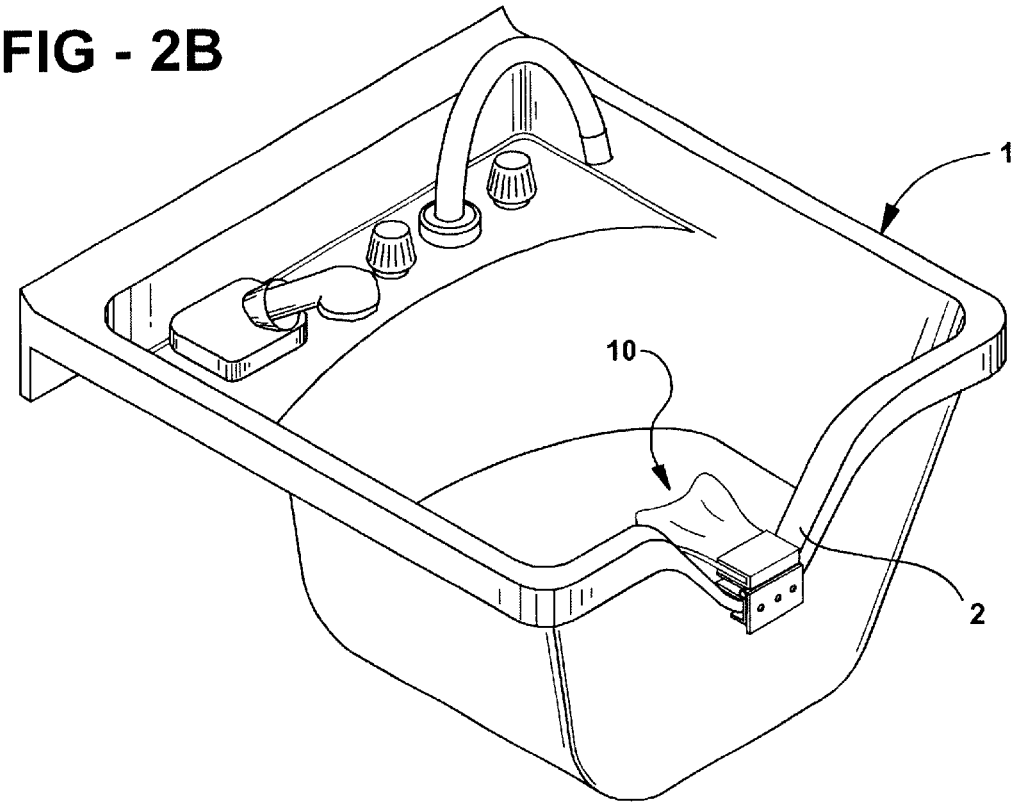

Referring now to FIGS. 3B and 3C, fasteners 28, such as hook and loop fasteners (e.g., VELCRO®), buttons, snaps, or an adhesive are secured or applied to the base 22 of the brace 12 for use in securing a foam pad 30. The foam pad 30 preferably has a size and shape similar to that of the brace 12. However, the pad 30 may be either larger or smaller than the brace 12. Alternatively, the pad 30 may include pockets or straps that are securable over or around the brace 12 to position the pad 30 on the brace 12 without the need for fasteners 28.

Figure 4A:
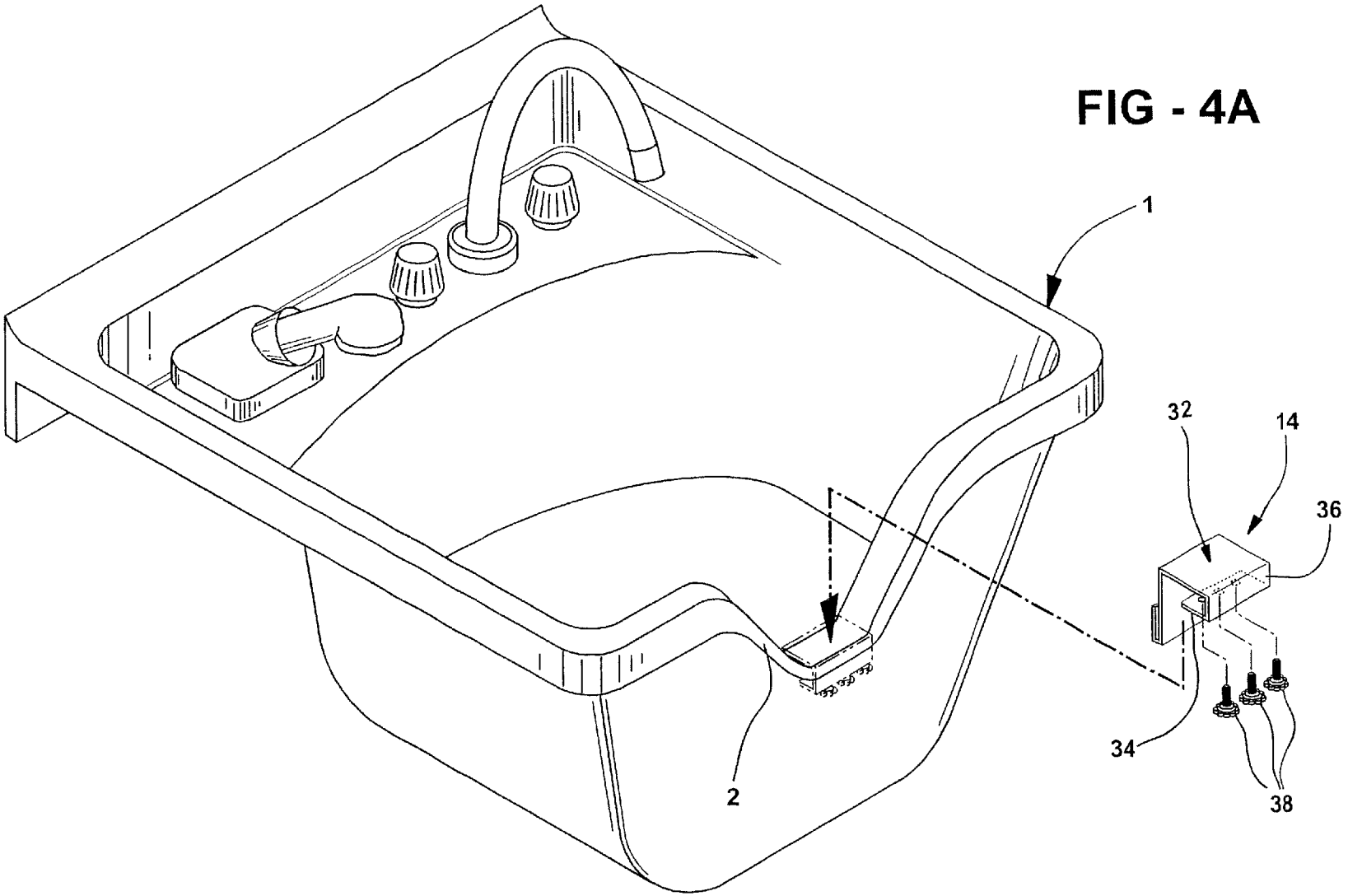
FIGS. 4A and 4B are perspective views of a mounting bracket for use with the present invention.
Figure 4B:
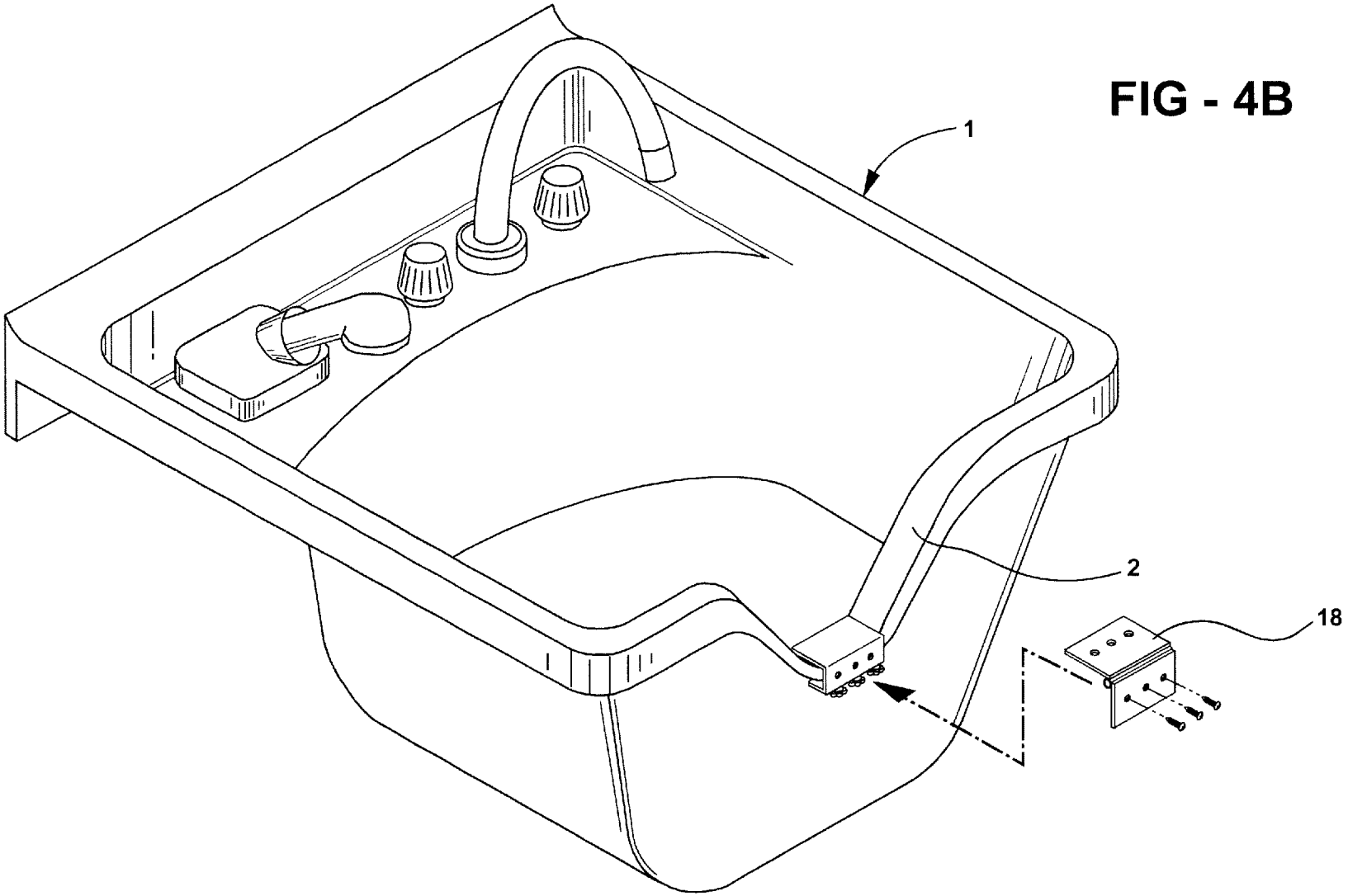

Referring now to FIGS. 4A and 4B, there is shown a mounting bracket 14 constructed in accordance with the present invention. Preferably, the mounting bracket 14 is securable to a wash basin 1 (e.g., a contoured edge 2 of a wash basin 1) and includes an L-shaped bracket having a hook portion 32 with a base 34 and a front face 36. The mounting bracket 14 is removably secured to the wash basin 1 by screws 38 that extend through the base 34 of the hook portion 32 and contact an underside 3 of the contoured edge 2 of the basin 1. Notably, although only a contoured wash basin 1 is shown, it will be appreciated that the mounting bracket 14 may be secured or adapted to be secured to a variety of wash basins.

Referring now to FIGS. 5A and 5B, there is shown a hinge assembly 16 that pivotally secures the brace 12 to the mounting bracket 14 and includes the hinge 18 and fastener clamp 20. As best shown in FIGS. 5B and 6A–6D, the fastener clamp 20 includes a base 40 with a pair of upwardly extending walls 42, 44. The walls 42, 44 define a channel 46 that is affixed to the second end 24 of the brace 12. Preferably, the hinge 18 of the hinge assembly 16 is a spring hinge having a tension that permits the controlled raising and lowering of the brace 12, and thus the individual's head and neck, into and out of the wash basin 1. The hinge 18 of the present invention also includes a first leaf 48 that is secured to the front face 36 of the mounting bracket 14 and a second leaf 50 that is secured to a wall 42, 44 of the clamp 20.

Figure 6B:
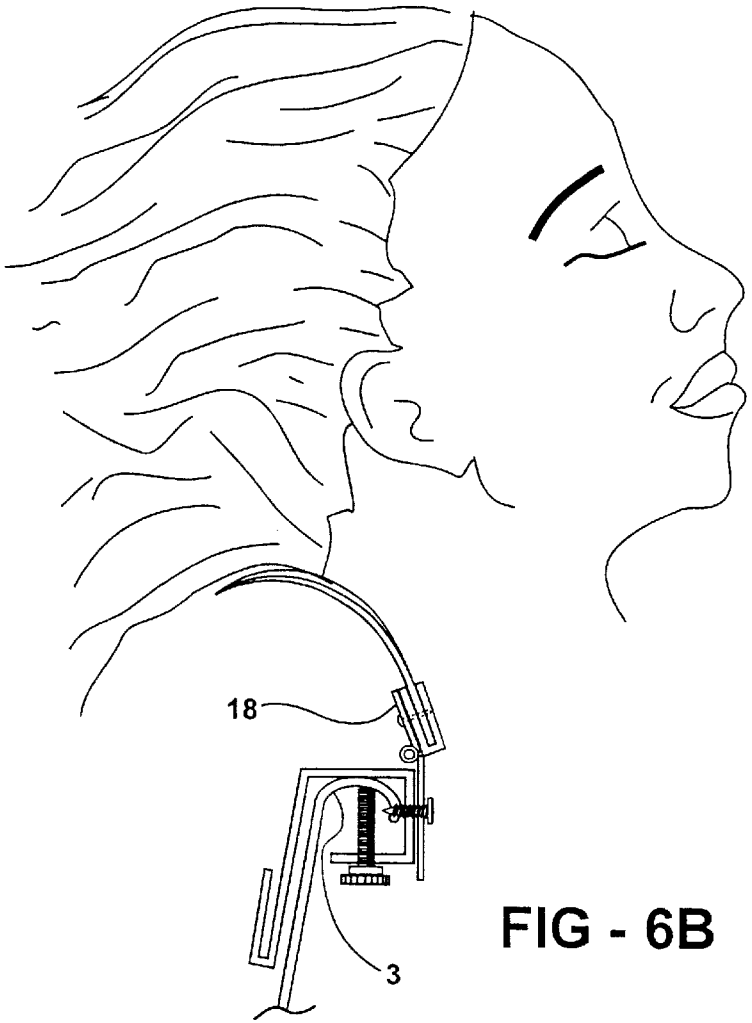
Figure 6A:
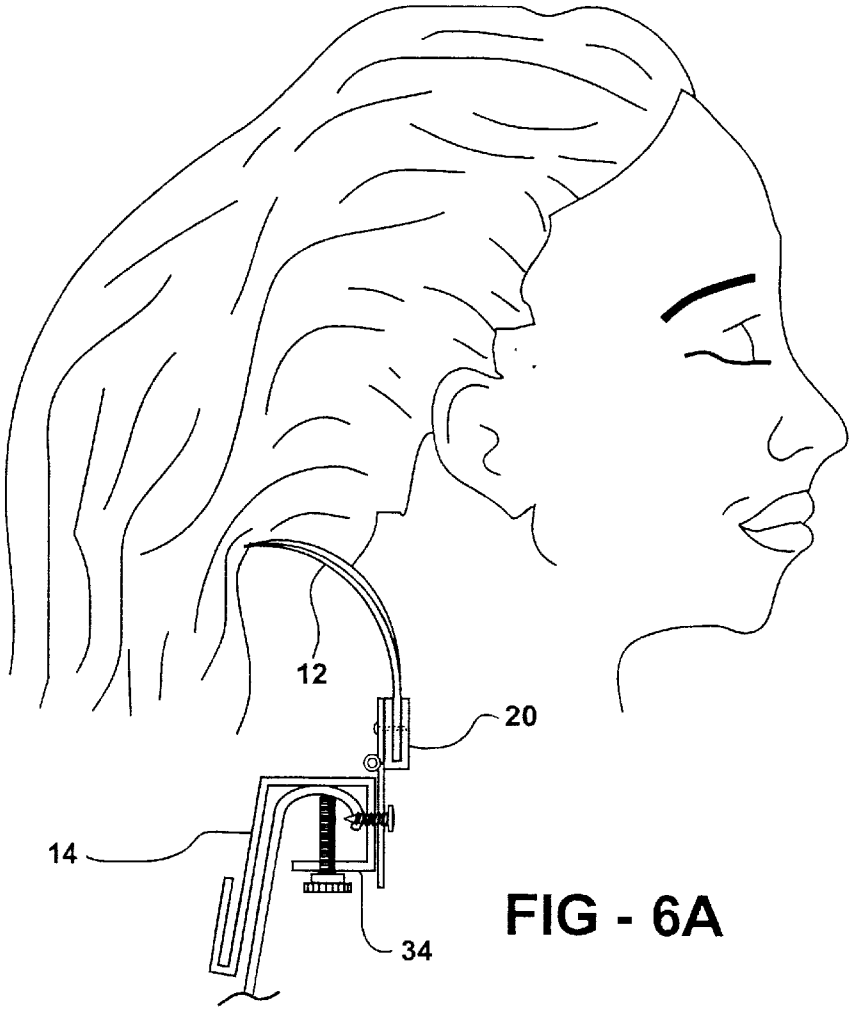

As shown in FIGS. 1A, 1B and 5A–5D, in operation, the cradle 10 of the present invention is removably secured along the contoured edge 2 of the wash basin 1 with the brace 12 being biased by the hinge 18 in a substantially vertical relationship with respect to the wash basin 1. Alternatively, the brace 12 may be inclined with respect to the wash basin 1 in order to assist engagement between the brace 12 and the neck of the user. Thereafter, as seen in FIGS. 6B–6D, as the individual places his or her head and neck in the brace 12, the hinge 18 assists in gently lowering the brace 12, and thus the head and neck of the individual, into the wash basin 1.

While the individual is having his or her hair washed, the cradle 10 assumes a generally horizontal orientation with respect to the wash basin 1 and functions to support the individual's head and neck. Once the individual has finished having his or her hair washed, the individual raises his or her head and neck from the wash basin 1. The individual is assisted in raising his or her head in a controlled manner by action of the hinge 18 that biases the neck brace 12 back toward a substantially vertical orientation.

Having thus described my invention, those having skill in the art will be aware of modifications and embodiments that, although not discussed, do not depart from the scope of the present invention.

What is claimed is:

1. A cradle for supporting a user's head relative to a wash basin, comprising:

a contoured brace adapted to be supported against the user's neck with a first end adjacent to the head of the user and a second end disposed toward the user's shoulder area;

a hinge having a first leaf connected to the second end of the brace and a second leaf connected to said wash basin so as to allow pivoting motion of the brace relative to the wash basin between a first, upright position in which the first end of the brace is vertically above the second end, and a second position in which the first and second ends of the brace are generally horizontally aligned over the basin; and means for biasing the brace toward the upright position;

whereby the user may bring his neck against the brace while it is in the upright position and the brace will support the neck as the user's head is moved into washing position relative to the basin.

2. The cradle of claim 1, wherein said means for biasing the brace toward the upright position comprises a hinge.

3. The cradle of claim 2, wherein said hinge comprises a spring hinge.

4. The cradle of claim 1, wherein said brace further comprises fasteners.

5. The cradle of claim 4, wherein said brace further comprises a pad removably secured to said fasteners.

6. The cradle apparatus of claim 1, further comprising a pad positioned on said brace.

7. A cradle for lowering and raising an individual's head into a wash basin, said cradle comprising:

a brace, said brace having pair of side-walls and a contoured base defining a substantially U-shaped cross section and an end;

a pad positioned on said brace;

an L-shaped mounting bracket, said mounting bracket having a hook portion adapted to be removably secured to a contoured edge of said wash basin and having a front face;

a fastener clamp, said fastener clamp having a base and a pair of walls extending upwardly from said base, said walls defining a channel into which is secured said end of said brace; and a hinge, said hinge having a first leaf secured to said front face of said bracket and a second leaf secured to said fastener clamp such that when said mounting bracket is secured to said wash basin the brace is pivotable between a substantially vertical position and a substantially horizontal position relative to said wash basin.

8. A cradle for positioning an individual's head in a wash basin, said cradle comprising:

a brace adapted to support at least a portion of an individual's neck as the individual's neck is raised and lowered into and out of said wash basin;

a mounting bracket, said mounting bracket being removably secured to the wash basin; and a hinge assembly, said hinge assembly comprising a hinge and a clamp, said clamp being secured to said brace and said hinge having a first leaf secured to said mounting bracket and a second leaf secured to said clamp such that when said mounting bracket is secured to said wash basin the brace is pivotable between a substantially vertical position and a substantially horizontal position.

* * * * *